United States Patent [19]

Krauss

[11] Patent Number: 4,606,158

[45] Date of Patent: Aug. 19, 1986

[54] DOUBLE SILO

[75] Inventor: Werner Krauss, Hamburg, Fed. Rep. of Germany

[73] Assignee: Claudius Peters Aktiengesellschaft, Hamburg, Fed. Rep. of Germany

[21] Appl. No.: 649,317

[22] Filed: Sep. 11, 1984

[30] Foreign Application Priority Data

Nov. 24, 1983 [DE] Fed. Rep. of Germany ..... 3342507

[51] Int. Cl.[4] ..... B01F 5/12; E04H 7/24

[52] U.S. Cl. ..... 52/192; 52/245; 366/107

[58] Field of Search ..... 52/192, 245; 366/101, 366/106, 107

[56] References Cited

U.S. PATENT DOCUMENTS

| | | | |
|---|---|---|---|
| 1,988,184 | 1/1935 | Wolfe | 52/192 |
| 3,648,985 | 3/1972 | Matweecha | 366/107 |
| 4,128,343 | 12/1978 | Moked et al. | 366/101 |
| 4,185,926 | 1/1980 | Lyon | 366/101 |
| 4,239,421 | 12/1980 | Krauss | 366/107 X |
| 4,273,451 | 6/1981 | Krauss | 366/101 |
| 4,506,985 | 3/1985 | Buchfink | 366/107 |

FOREIGN PATENT DOCUMENTS

| | | | |
|---|---|---|---|
| 64572 | 11/1982 | European Pat. Off. | 52/192 |
| 1507888 | 7/1975 | Fed. Rep. of Germany . | |
| 2657597 | 6/1978 | Fed. Rep. of Germany | 366/101 |
| 3015668 | 10/1981 | Fed. Rep. of Germany . | |
| 3040749 | 6/1982 | Fed. Rep. of Germany | 366/101 |
| 31334 | 3/1978 | Japan | 52/192 |

*Primary Examiner*—Stuart S. Levy
*Assistant Examiner*—Joseph J. Hail, III
*Attorney, Agent, or Firm*—Eric P. Schellin

[57] ABSTRACT

Double silo with an inner silo part and an outer silo part which surrounds it annularly. A central mixing chamber for the material emanating from the inner silo area and an annular mixing chamber for the material emanating from the outer silo area are located within the silo dividing wall separating the two silo parts and at the bottom in the inner silo part.

9 Claims, 4 Drawing Figures

DOUBLE SILO

BACKGROUND OF THE INVENTION

The invention relates to a double silo with an inner silo part and an outer silo part which surrounds it in an annular manner and is separated from it by a basically vertical silo dividing wall, and with an annular, aerated emptying chamber at the bottom of the inner silo part for the silo area formed in the outer silo part which emptying chamber is connected to the silo area by a plurality of openings in the silo dividing wall near the bottom.

In a known double silo of this type (DE-OS 30 15 068), incorporated herein by reference, the inner silo part has annularly running sloping surfaces under which the annular emptying chamber for the outer silo area is located. This is intended to create good conditions for removal in the outer silo area which are just as advantageous as those in the inner silo area, the removal devices of which are centrally located.

The prior art silo is not intended to have a mixing operation, which can be recognized, among other things, from the fact that no mixing chamber is associated with the inner silo area and that the annular emptying chamber for the outer silo area has neither the capability of being heavily aerated, which would be necessary for mixing the material in a mixing chamber, nor the height required for the volumetric expansion of the material in the process of being admixed in a mixing chamber. In other words, the prior art emptying chamber is not a mixing chamber, because the term mixing chamber denotes a non-tension emptying chamber which is added onto the outlet side of a silo area and has such a height and high aerability that the material removed from the silo not only simply passes through this chamber but is also rotated and uniformly mixed in a considerable volume in it by zones of differing aeration, see (DE PS 15 07 888) for instance, also incorporated herein by reference. Such mixing chambers are therefore also designated as uniform mixing chambers. Nevertheless, the double concentric silo, initially mentioned, has proven to be especially advantageous, among other reasons, because it combines a good emptying capacity of both silo areas with good static qualities. While the arrangement of several volumetric cells over each other can normally result in considerable problems in structures with such a high static stress as silos, in this known double silo the annular emptying chamber for the outer silo area is created under the inwardly sloping surface of the inner silo area without this causing a deterioration of the static conditions in the area of the silo bottom, because the sloping surfaces in the inner silo area have to be provided in any case and the central bottom area of the inner silo area can be set directly on the undisturbed ground or on the main silo bottom.

The invention has the task of creating such a silo arrangement in which mixing chambers are added to the outlet silo of the two silo areas.

Since mixing chambers must be considerably larger than the emptying chambers initially mentioned, and, in distinction to the known arrangement, not only the outer, but also the inner silo area should be provided with such a chamber, the solution of the task of the invention cannot presuppose static conditions which are as advantageous as those extant in the known silo arrangement.

SUMMARY OF THE INVENTION

The solution as set forth in the invention consists in the fact that the annular chamber encloses a central chamber connected to the silo area formed in the inner silo part by means of a basically vertical chamber concentric dividing wall and that both chambers are constructed as aerating mixing chambers.

As all mixing chambers in the inner silo part operate cooperatively, the vertical silo dividing wall can remain as an important static element. Also, the outer silo part can retain the relatively simple form which rests directly on the undisturbed ground or the main silo bottom. It must be accepted, on account of the not inconsiderable height of a mixing chamber, that the useful height of the inner silo area will be correspondingly reduced, so that its diameter must be enlarged in order to maintain a pre-set volume. Accordingly, the horizontal construction units which limit the inner silo area on its bottom are also correspondingly more extensive and thus pose more of a static problem. Moreover, these construction units are deprived of a direct support on the undisturbed ground or on the main silo bottom on account of the mixing chambers to be located under them.

However, this static disadvantage is negated by the fact that the horizontal construction units which limit the inner silo area from below receive an additional, central support from the basically vertical chamber dividing wall. The plurality of the vertical and horizontal construction units connected integrally to each other here results in a cellular system which is statically extremely resistant and is also easy to calculate. This is particularly true when, according to an advantageous feature of the invention, the chamber dividing wall is arranged at least for the most part concentrically to the silo dividing wall, thus, e.g., cylindrically or partially cylindrically or polygonally or in a star-shaped pattern.

Moreover, the invention also provides that the annular chamber can be subdivided into a plurality of separate chambers, whereby the radial dividing walls located between these separate chambers represent additional stiffening ribs.

A particularly advantageous embodiment provides that the inner silo area is connected to the inner mixing chamber by at least one spacious shaft which runs down to near the bottom of the inner mixing chamber. It is advantageous if several shafts distributed evenly along the circumference are provided which open into the inner silo area with a relatively large cross section which is preferably at least approximately 5%, and better yet at least approximately 10% of the inner area of the silo bottom. Since the shafts then have dimensions on the order of several meters in every direction, there is no problem with afterflow. They form a spacial and functional part of the silo area, especially if, in accordance with another feature of the invention, the shaft bottoms are stronger than the other surfaces which limit the inner silo area underneath and can, if required, be aerated in an alternating manner, so that the formation of funnels, which is so predominantly present in the mixing action of a mixing chamber silo, starts within the main silo area from the shafts.

The mixing chambers associated with the two silo areas can be provided with advantage with removal devices which can be operated independently of each other. However, it can also be advantageous if, instead of this, or in addition to this, they can be connected to each other. The latter instance is advantageous, for example, if the same material or materials to be mixed is stored in both silo areas. In this case the arrangement can also be such that the mixing chambers are connected in series, that is, so that the material which has passed through the one mixing chamber subsequently passes into the other mixing chamber and is uniformly mixed or homogenized there with the material originating from the other silo area. To this end the mixing chambers can be built in a cascade, that is, their dividing wall contains at least one overflow opening in its upper part through which the material piling up in the mixing chamber it flowed through first flows into the second mixing chamber.

BRIEF DESCRIPTION OF THE DRAWINGS

The invention is described in more detail below with reference made to the drawings which show an advantageous embodiment.

DETAILED DESCRIPTION OF THE INVENTION

Figure 1:
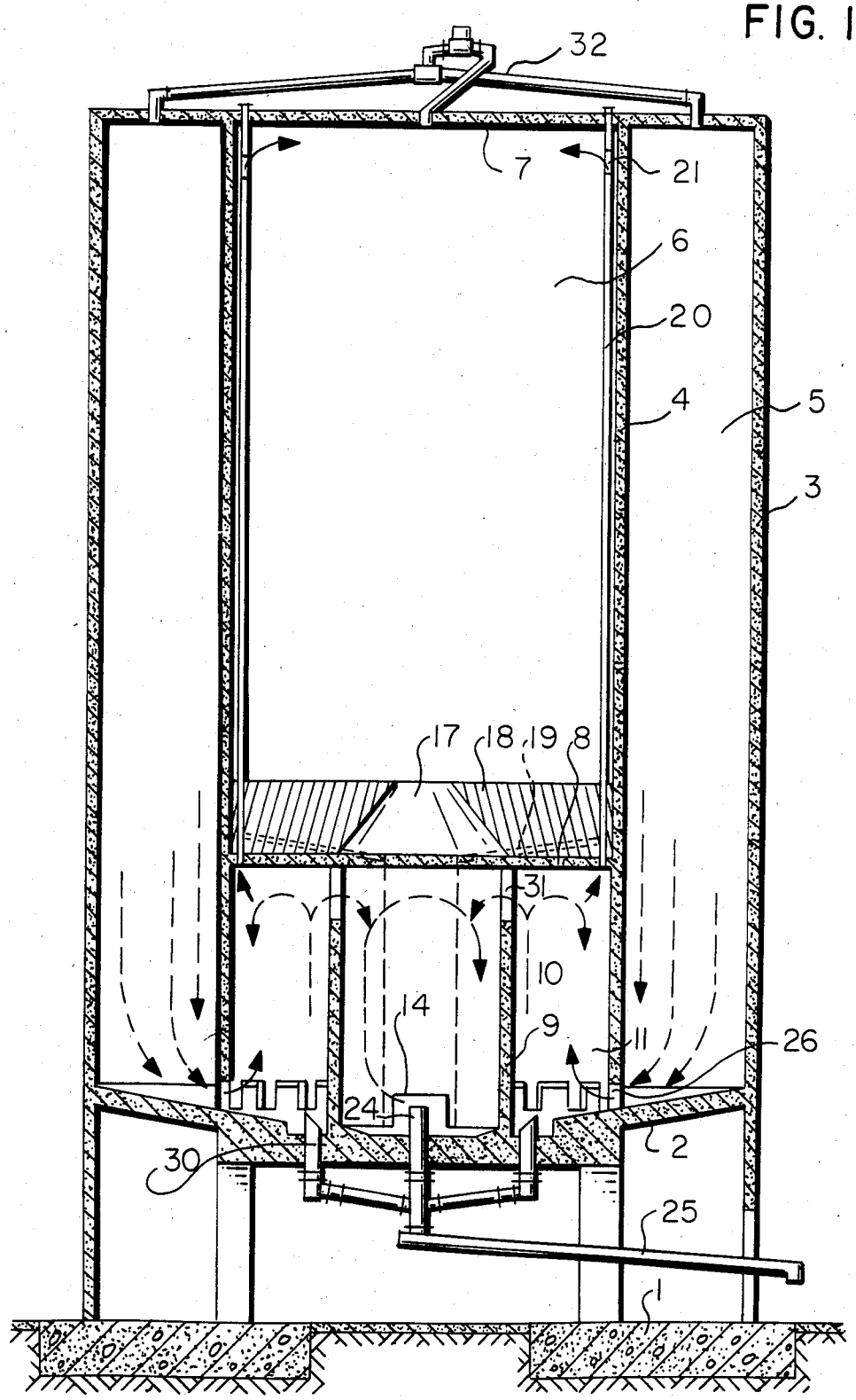
FIG. 1 shows a vertical section through the silo along line I—I of FIG. 3.
Figure 2:
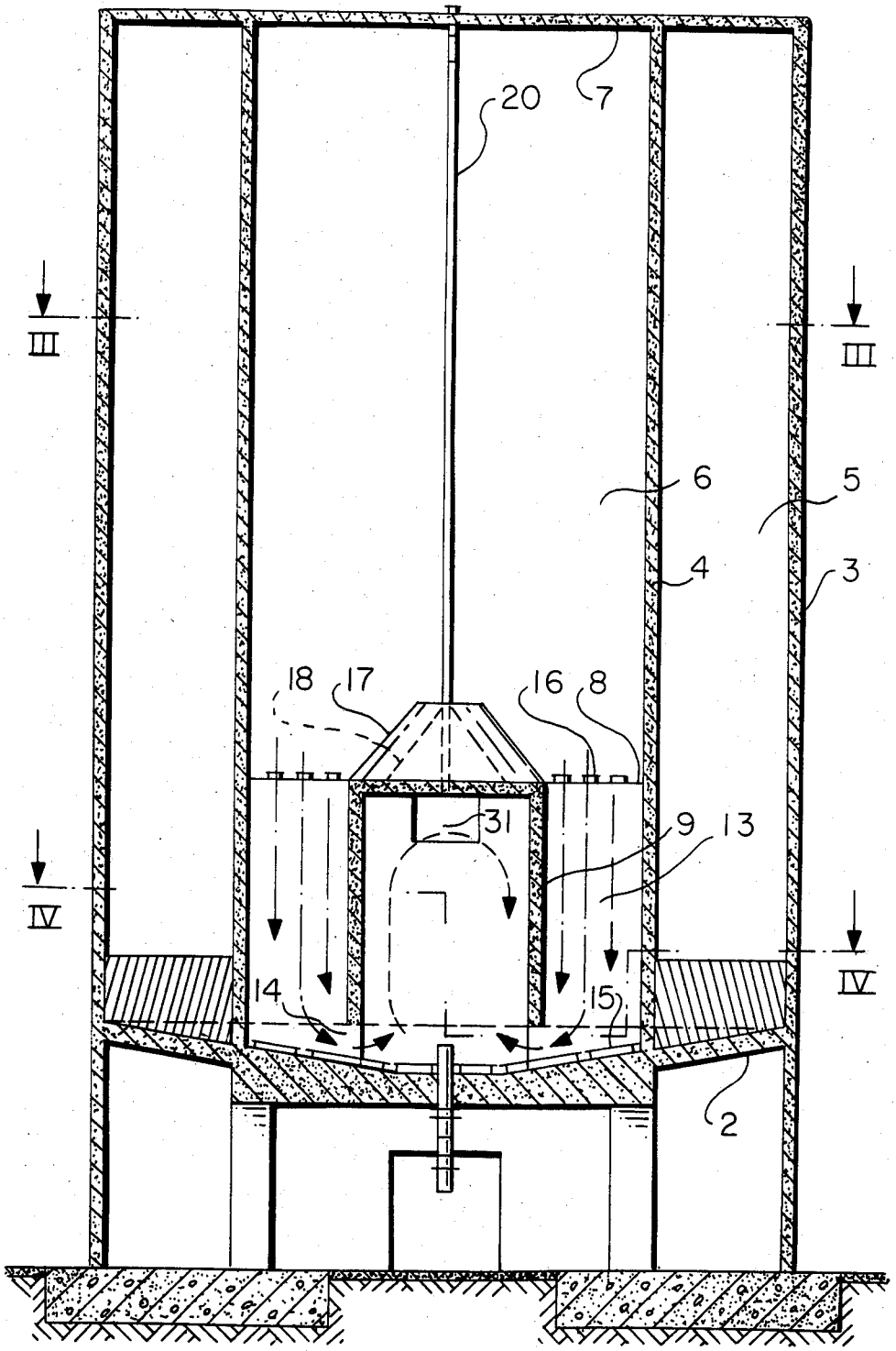
FIG. 2 shows a vertical section along line II—II of FIG. 3.
Figure 3:
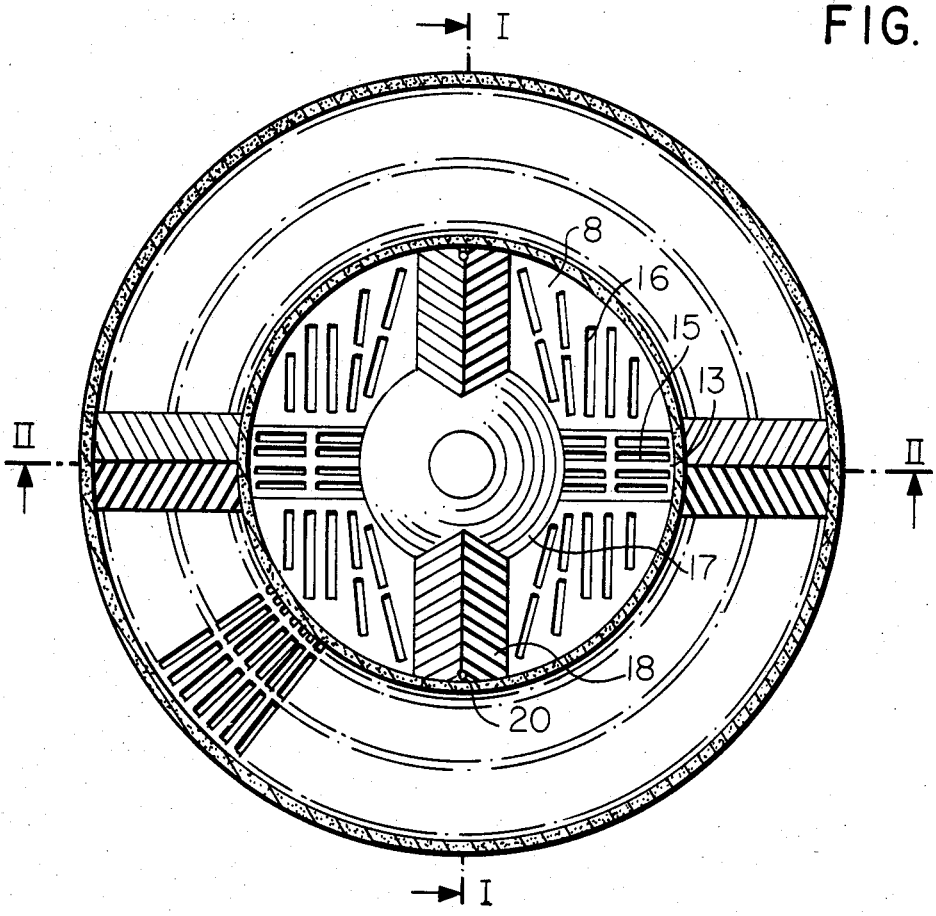
FIG. 3 shows a horizontal section along line III—III of FIG. 2.

Main silo bottom 2, which is constructed as a common base plate for all silo parts, is preferably supported on foundation 1 by means of suitable supports. It could also be set on the undisturbed ground, which would necessitate a different, but known removal system.

Outer cylindrical silo wall 3 extends upwardly on the outside from main silo bottom 2 and concentrically to it the likewise cylindrical dividing wall 4 spaced from the said silo wall 3. Annular outer silo area 5 is located between them, while inner silo area 6 is located internally of the silo dividing wall. Both silo areas are closed at the top by silo cover or top 7.

Figure 4:
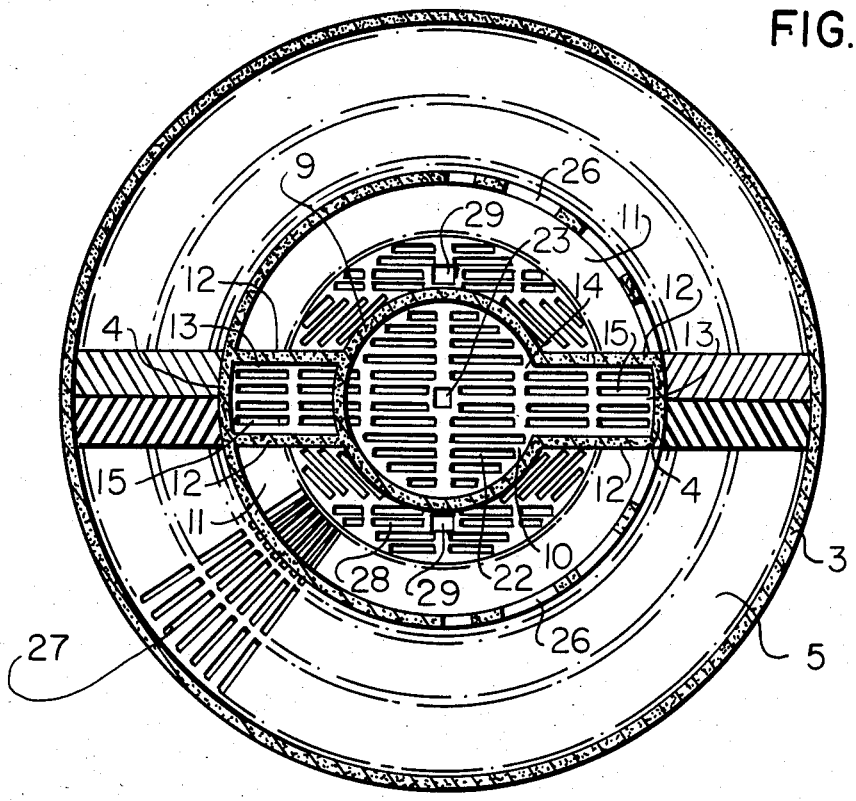
FIG. 4 shows a horizontal section along line IV—IV of FIG. 2.

The bottom of outer silo area 5 is formed by main silo bottom 2. The lower limitation of inner silo area 6 is located for the most part at such a height above main silo bottom 2 that the height necessary for the mixing chambers is present between them. In it cylindrically, vertically dividing wall 9 arranged concentrically to silo walls 3, 4 separates inner mixing chamber 10 and outer, partially annular mixing chamber 11. It is therefore designated here as chamber dividing wall 9. It is cylindrically closed over substantially, as can be seen from FIG. 4. It thus forms, together with silo dividing wall 4, excellent static conditions for the support of chamber tops 8, which carry the contents of inner silo area 6. Chambers dividing wall 9 is connected on two diametrically opposite sides to silo dividing wall 4 by wall pairs 12 as can be seen from FIG. 4. Wall pairs 12, together with chamber dividing wall 9 and silo dividing wall 4, surround a shaft 13 which is limited at the bottom by main silo bottom 2 and is open at the top to inner silo area 6. Chamber dividing wall 9 has a plurality of communicating openings 14 in its section near the bottom. The material stored in central main silo area 6 can therefore flow through the two shafts 13 and openings 14 into inner mixing chamber 10 when it is sufficiently fluidized by bottom aeration. Suitable aeration devices 15 on the bottom of shafts 13 are used for this purpose. Furthermore, aeration devices 16 are provided on chamber top 8 which aid in the massive flow of the material to shafts 13. Conical slope 17 above inner mixing chamber 10 and saddle-shaped or upsidedown V-shaped slopes 18 above a diameter running transversally to shafts 18 serve the same purpose. They also contain conduits 19 for aerating inner mixing chamber 10 which are connected to two aeration lines 20 which are held on silo dividing wall 4, which run into the upper silo area and are open there at 21. Inner mixing chamber 10 is provided on the bottom with aeration devices 22 which can be vigorously aerated in different zones in order to uniformly mix the material contained in it, so that the material is vigorously rotated in it with a good mixing action before it leaves the mixing chamber through outlet opening 23, which has a raised edge 24 for avoiding short-circuit currents. Outlet opening 23 leads over suitable closure members to removal line 25.

As is known, the mixing action of a mixing chamber silo is essentially based on two mixing processes. The first mixing process occurs in the silo area when, as a result of rather vigorous zoned aeration and the removal of material from the rather vigorously aerated zone, a so-called removal funnel zone develops over it in which the material from different stored layers of material come together. The second mixing process is the uniformly mixing and homogenizing of the material removed from the main silo area in the mixing chamber. In the present embodiment the funnel zones in inner silo area 6 are advantageously allowed to start from shafts 13 by loading their aeration devices 15 more heavily with compressed air than aeration devices 16 in the inner silo area. The force of the aeration is limited in such a manner that only a limited afterflow of material from the silo area into the mixing chamber occurs in order that it is not hydrostatically overflooded. This is possible because shafts 13 assure an even afterflow of the material to the mixing chamber even when the material in them and loading them from above in the silo area is loosened in a limited manner. This is even the situation when uneven movements of the material (formation of bridges, collapses) due to the weak aeration in the main silo area must be considered. Aeration devices 15 in shafts 13 can be operated serially or alternatingly so as to form alternating mixing funnel zones in inner silo area 6. It is also contemplated to provide that in addition to aeration devices 15 of shafts 13 parts of aeration devices 16 are constructed for a rather vigorous zoned aeration and funnel formation if the material loading chamber top 8 on both sides of shafts 13 in the inner silo area can not participate sufficiently evenly otherwise in the removal of material. Instead of this, it is also possible to provide more than two shafts 13 for the removal of the material from the silo area in the mixing chamber, e.g. three or four schafts distributed evenly over the circumference.

In the annular area between chamber dividing wall 9 and silo wall 4 shaft walls 12 separate two approximately semicircular chambers 11 from one another which are connected via openings 26 near the bottom to outer silo area 5 and form the mixing chambers for it. If more than two shafts 13 are provided, the number of these partially circular outer mixing chambers is correspondingly increased and multiplied. Aeration devices 27 provided on the bottom of outer silo area 5 run through openings 26 into the outer mixing chambers, in which aeration devices 28 are provided for an intensive homogenizing and uniform mixing aeration differing by zones. Aeration devices 27 in the outer silo area can be operated with advantage in zones with differing intensity in order to make possible the cited formation of removal funnel zones in the outer silo area also.

Outer mixing chambers 11 are aerated by lines 20 and have outlet openings 29 which have a raised collar 30 for avoiding short-circuit flows and lead via appropriate closure members to a removal line. The present embodiment provides that they run into the same removal line 25 as outlet opening 23 of the inner mixing chamber. This is advantageous if material is removed from the two silo areas either only alternatingly or the stored, possibly differing qualities of the material are used only conjointly and in a ratio which can be regulated by the closure members. An example for this is the storing of raw dust for the production of cement. The directed application of the mixing possibilities offered by the two silo areas permits a compensation of fluctuations in composition which is longer-lasting than would be possible if only one correspondingly larger silo were used.

It is, however, of course also possible to connect the outlet openings of the mixing chambers to different removal lines or to provide the possibility of a common or separate take-off.

If the material qualities which stem from the two silo areas and can be homogenized separately in the associated mixing chambers are not only to be brought together but also to be mixed or homogenized together, the mixing chambers can be connected together in a so-called cascade by providing overflow openings 31 in the upper area of chamber dividing wall 9 which make possible the following procedure illustrated in FIG. 1. The material stemming from the outer silo area is homogenized in the outer mixing chamber and then is not removed via outlet opening 29 but rather is allowed to constantly flow over through opening 31 into the inner mixing chamber by an appropriately high setting of the level of the material being mixed in the outer mixing chamber, so that not only the material stemming from inner silo area 6 but also the material flowing over from the outside is homogenized in the inner mixing chamber and can finally be removed through outlet opening 23. The process could of course also occur in reverse. The setting of the mixing level in the chamber from which the material should flow over into the other chamber is performed by the setting of the intensity of the aeration. To this end the compressors provided for supplying aeration devices 22, 28 and, if required, also 13, 27 can be appropriately regulated in order that the amount of the material flowing over from the one mixing chamber into the other mixing chamber and therewith the mixing ratio can be set by adjusting the aeration.

Known distributing devices 32 can be used to move the material into the silo areas. If the silo areas operate independently of each other in individual operation, the distributor shown is naturally set so that only the one or the other silo area is alternatingly loaded. The same applies if the silo areas are operated in a compound operation and fluctuations of composition of one and the same material in time are to be compensated by dephased entry into the two silo areas or by dephased removal from them. However, both silo areas can also be loaded parallel to one another.

The advantages of the invention consist on the one hand in the fact that great silo volumes can be made available under very advantageous static conditions in a very compact silo construction. The cellular construction shown with several cylinders arranged in each other and connected to each other results in a great strength and this makes it possible, for example, to eliminate the normally required pretensioning of the reinforcement in the case of silo diameters greater than 20 m, which saves considerable expense. The span width of the tops is considerably less, so that an advantageous cost structure is also obtained therefrom. Other advantages apply to the conditions of introducing the material, removing it and the possibilities of mixing. Since the horizontal paths are comparatively small in any silo area, an even massive flow can be achieved and therewith a good utilization of the available silo area. The possibility of allowing the silo cells to operate individually in parallel or in cascade from the inside to the outside or vice versa results in many possibilities of mixing with rather long damping lengths of fluctuation in composition without the necessity of intermediate transport, as is often necessary in separately standing silo groups.

What is claimed is:

1. In a double silo with an inner silo part and an outer silo part which surrounds it annularly and is separated from it by a vertical silo dividing wall, with an annular aerated emptying chamber at the bottom of the inner silo part for the silo area formed in the outer silo part, which emptying chamber is connected to the silo area by a plurality of openings in the silo dividing wall near the bottom, wherein the annular aerated mixing chamber (11) is divided into a plurality of separate chambers for the material emanating from the outer silo area, and which encloses a central aerated mixing chamber (10) for the material emanating from the inner silo area; said central chamber is connected to the inner silo part area (6) by a vertical chamber dividing wall (9), arranged concentrically to a silo dividing wall (4); wherein inner silo area (6) is connected to the inner mixing chamber by at least one spacious shaft (13) which runs down close to the bottom (2) of inner mixing chamber (10).

2. Silo according to claim 1, wherein a plurality of shafts (15) distributed evenly over the circumference are provided, each of which opens into the inner silo area (6) with an inside cross section of at least approximately 5% of the inner cross-sectional area of the silo area.

3. Silo according to claim 2, wherein the shafts (15) have an opening area of approximately 10% of the inner cross-sectional area of the silo area.

4. Silo according to claim 3, wherein the bottoms of the shafts have means whereby they can be aerated more vigorously than the other areas (8) which limit the inner silo area on the bottom.

5. Silo according to claim 4, wherein the bottoms of the shafts have means whereby they can be alternatingly aerated.

6. Silo according to claim 5, wherein the mixing chambers (10, 11) are equipped with removal devices (23, 25, 29) capable of being operated independently of each other.

7. Silo according to claim 6, wherein the removal devices (23, 29) of the mixing chambers (10, 11) are connected.

8. Silo according to claim 7, wherein the mixing chambers (10, 11) are connected in series.

9. Silo according to claim 8, wherein the chamber dividing wall (9) has at least one overflow opening (31) in its upper part.

* * * * *